US009513646B2

(12) United States Patent
Lan

(10) Patent No.: US 9,513,646 B2
(45) Date of Patent: Dec. 6, 2016

(54) LOW DROPOUT REGULATOR

(71) Applicant: Taiwan Semiconductor Manufacturing Company Limited, Hsinchu (TW)

(72) Inventor: Po-Hsiang Lan, Taipei (TW)

(73) Assignee: Taiwan Semiconductor Manufacturing Company, Hsinchu (TW)

( * ) Notice: Subject to any disclaimer, the term of this patent is extended or adjusted under 35 U.S.C. 154(b) by 0 days.

(21) Appl. No.: 14/554,146

(22) Filed: Nov. 26, 2014

(65) Prior Publication Data

US 2016/0147240 A1 May 26, 2016

(51) Int. Cl.

| | |
|---|---|
| ***G05F 1/56*** | (2006.01) |
| ***G05F 1/575*** | (2006.01) |
| ***G05F 1/614*** | (2006.01) |
| ***G05F 1/565*** | (2006.01) |

(52) U.S. Cl.

CPC ..... *G05F 1/575* (2013.01); *G05F 1/56* (2013.01); *G05F 1/565* (2013.01); *G05F 1/614* (2013.01)

(58) Field of Classification Search

CPC ..... G05F 1/56; G05F 1/562; G05F 1/563; G05F 1/565; G05F 1/614; G05F 1/575

See application file for complete search history.

(56) References Cited

U.S. PATENT DOCUMENTS

| | | | | |
|---|---|---|---|---|
| 4,095,164 | A * | 6/1978 | Ahmed | G05F 1/613 323/226 |
| 5,894,215 | A * | 4/1999 | Yazdy | G05F 3/247 323/282 |
| 6,441,594 | B1 * | 8/2002 | Connell | G05F 1/575 323/274 |
| 6,490,142 | B1 * | 12/2002 | Smith | G05F 1/613 323/282 |
| 6,586,917 | B1 * | 7/2003 | Smith | G05F 1/565 320/145 |
| 6,696,822 | B2 * | 2/2004 | Takabayashi | G05F 1/618 323/224 |
| 6,771,115 | B2 * | 8/2004 | Nakano | G11C 5/147 327/407 |
| 6,967,470 | B2 * | 11/2005 | Takabayashi | G05F 1/618 323/224 |
| 7,427,890 | B2 * | 9/2008 | Chan | H02M 3/07 327/536 |

(Continued)

*Primary Examiner* — Thomas J Hiltunen
(74) *Attorney, Agent, or Firm* — Jones Day

(57) ABSTRACT

A low dropout regulator and system for supplying power to a card are provided. A low dropout regulator includes a reference voltage supply circuit configured to output a reference voltage based on an input supply voltage. An error amplifier has a first input, a second input, and a single-ended output. The first input is coupled to the reference voltage, and the second input is coupled to an output node of the low dropout regulator via a first feedback resistor. A pass transistor includes a control electrode connected to the single-ended output of the error amplifier, a first electrode connected to a ground node, and a second electrode connected to the output node of the low dropout regulator. A first power supply terminal of the error amplifier is connected to the output node, and the output node provides an output voltage of the low dropout regulator that powers the error amplifier.

20 Claims, 7 Drawing Sheets

(56) References Cited

U.S. PATENT DOCUMENTS

| | | | | |
|---|---|---|---|---|
| 7,675,272 | B2 * | 3/2010 | Michallick | G05F 1/565 323/266 |
| 7,969,127 | B1 * | 6/2011 | Megaw | G05F 1/613 323/226 |
| 8,085,006 | B2 * | 12/2011 | Burger-Riccio | G05F 1/613 323/223 |
| 8,313,034 | B2 * | 11/2012 | Okuda | G06K 19/0701 235/492 |
| 8,461,812 | B2 * | 6/2013 | Kim | G05F 1/613 323/225 |
| 8,593,254 | B2 * | 11/2013 | Okuda | G06K 19/0701 235/492 |
| 8,665,007 | B2 * | 3/2014 | Ochoa | H01L 27/0285 327/541 |
| 9,128,501 | B2 * | 9/2015 | Tan | G05F 3/16 |
| 2007/0216473 | A1 * | 9/2007 | Yamazaki | G11C 5/147 327/540 |
| 2012/0062197 | A1 * | 3/2012 | Luders | G05F 1/565 323/282 |
| 2013/0307506 | A1 * | 11/2013 | Oh | G05F 1/10 323/282 |
| 2015/0212529 | A1 * | 7/2015 | Cherewka | G05F 1/56 323/303 |

* cited by examiner

LOW DROPOUT REGULATOR

BACKGROUND

Voltage regulators are used to provide a stable power supply voltage independent of load impedance, input voltage variations, temperature, and time. A low dropout (LDO) voltage regulator is a type of voltage regulator that can provide a low dropout voltage, i.e., a small input-to-output differential voltage, thus allowing the LDO regulator to maintain regulation with small differences between input voltage and output voltage. LDO regulators are used in a variety of applications in electronic devices to supply power. For example, LDO regulators are commonly used in battery-operated consumer devices. Thus, an LDO regulator is used, for example, in a mobile device such as a smartphone to deliver a regulated voltage from a battery power supply to various components of the mobile device.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features is arbitrarily increased or reduced for clarity of discussion.

DETAILED DESCRIPTION

Figure 1:
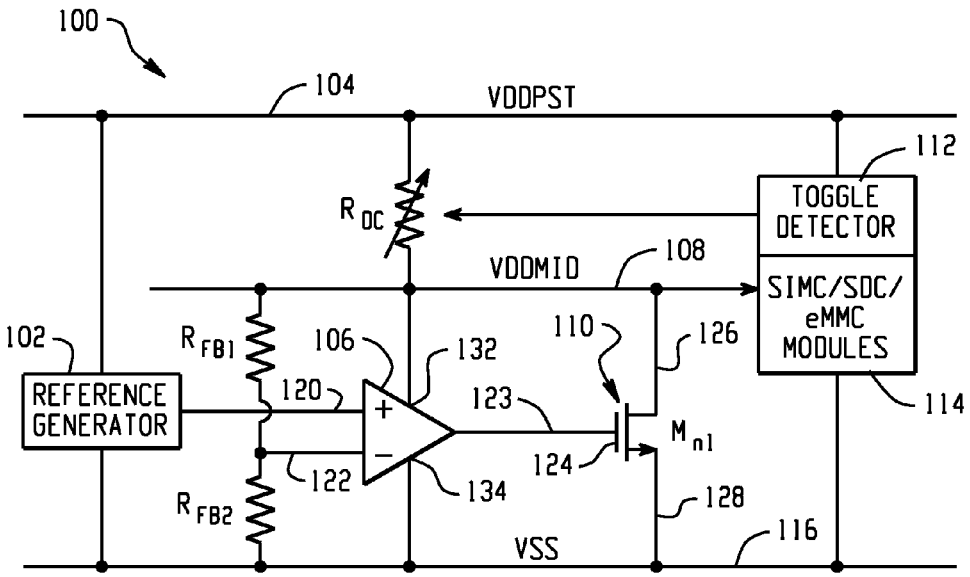
FIG. 1 depicts an example LDO regulator for supplying an output voltage (VDDMID) to SIMC, SDC, and/or eMMC modules, in accordance with some embodiments.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features is formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts an example LDO regulator 100 for supplying an output voltage (VDDMID) to SIMC, SDC, and/or eMMC modules 114, in accordance with some embodiments. The LDO regulator 100 includes a reference voltage supply circuit 102 that may output a reference voltage based on an input supply voltage VDDPST received from a power supply line 104. Changes in the input supply voltage VDDPST may cause the reference voltage output from the reference voltage supply circuit 102 to change. For example, an increase in the input supply voltage VDDPST may cause the reference voltage to increase, and a decrease in the input supply voltage VDDPST may cause the reference voltage to decrease.

The LDO regulator 100 further includes an error amplifier 106 (i.e., a differential amplifier). The error amplifier 106 has a first input 120 and a second input 122. The first input 120 is coupled to the reference voltage supply circuit 102, enabling the first input 120 to receive the reference voltage. The second input 122 is coupled to an output node 108 of the LDO regulator 100 via a first feedback resistor $R_{FB1}$. As illustrated in FIG. 1, the output node 108 of the LDO regulator 100 is coupled to the power supply line 104 via a resistor $R_{DC}$. The second input 122 is coupled to a ground node 116 via a second feedback resistor $R_{FB2}$. The error amplifier 106 has a single-ended output 123.

The single-ended output 123 of the error amplifier 106 is coupled to a pass transistor 110. The pass transistor 110, which may also be known as a power transistor, includes a control electrode 124 that is coupled to the single-ended output 123 of the error amplifier 106. The pass transistor 110 includes a first electrode 128 connected to the ground node 116 and a second electrode 126 connected to the output node 108 of the LDO regulator 100. In the example of FIG. 1, the pass transistor 110 is an n-type MOS transistor, such that the control node 124 is a gate terminal, the first electrode 128 is a source terminal, and the second electrode 126 is a drain terminal. It should be understood that the n-type MOS transistor used in the example of FIG. 1 is exemplary only, and that in other examples, a p-type MOS transistor or another type of transistor is used as the pass transistor.

A voltage present at the second input 122 of the error amplifier 106 is a fraction of an output voltage VDDMID of the LDO regulator 100, with the fraction being determined based on a ratio of resistance values of the feedback resistors $R_{FB1}$ and $R_{FB2}$. In the error amplifier 106, the voltage at the second input 122 is compared to the reference voltage received at the first input 120. The error amplifier 106 is configured to drive the pass transistor 110 to an appropriate operating point that ensures the output voltage VDDMID at the output node 108 is at a correct voltage. As the operating current or other conditions change, the error amplifier 106 modulates the pass transistor 110 to maintain the correct output voltage.

In the example of FIG. 1, the error amplifier 106 is configured to drive the pass transistor 110 to an operating point that causes the output voltage VDDMID to be approximately one half of the input supply voltage VDDPST. The output voltage VDDMID at the output node 108 is said to "track" the input supply voltage VDDPST. Thus, changes in the input supply voltage VDDPST cause the output voltage VDDMID of the LDO regulator 100 to change, where an increase in the input supply voltage VDDPST causes the output voltage VDDMID to increase, and a decrease in the input supply voltage VDDPST causes the output voltage VDDMID to decrease. This tracking is enabled, at least in part, based on the reference voltage output from the reference voltage supply circuit 102 that changes in response to changes in the input supply voltage VDDPST. For example, an increase in the input supply voltage VDDPST causes the reference voltage to increase, and based on this change in the reference voltage, the error amplifier 106 drives the pass transistor 110 to generate an increased output voltage VDDMID.

As described below with reference to FIG. 2, the example LDO regulator 100 is embedded in a card interface that is used to provide power to a card (e.g., a Subscriber Identity Module (SIM) card, a Secure Digital Card (SDC), an embedded Multi-Media Card (eMMC), etc.). Thus, FIG. 1 shows the output voltage VDDMID of the LDO regulator 100 being provided to SIMC, SDC, and/or eMMC modules 114 that are included in such a card interface. The SIMC, SDC, and/or eMMC modules 114 includes, for example, serially-coupled inverters and a post-driver circuit that are described in greater detail below.

In conventional card interfaces lacking the embedded LDO 100, a voltage received by the SIMC, SDC, and/or eMMC modules 114 is a constant voltage that is independent of the input supply voltage VDDPST. Thus, in such conventional card interfaces, changes in the input supply voltage VDDPST do not result in changes to the VDDMID voltage received by the SIMC, SDC, and/or eMMC modules 114, and this can result in various problems. For example, in conventional card interfaces where a voltage received by the modules 114 is constant, it is required to fabricate PMOS and NMOS components included in the modules 114 at sizes that vary greatly from each other, and this is undesirable. The embedded LDO 100 of FIG. 1, with its output voltage VDDMID that tracks the input supply voltage VDDPST, may thus remedy one or more of the problems inherent in the conventional card interfaces.

With reference again to the example LDO regulator 100 of FIG. 1, the error amplifier 106 includes i) a first power supply terminal 132 that is connected to the output node 108, and ii) a second power supply terminal 134 that is connected to the ground node 116. Using the connection from the first power supply terminal 132 to the output node 108, the output voltage VDDMID at the output node 108 powers the error amplifier 106. As illustrated in FIG. 1, the first power supply terminal 132 of the error amplifier 106 is not directly connected to the power supply line 104, such that the error amplifier 106 is not powered by the VDDPST input supply voltage.

The VDDPST input supply voltage may vary within a range of approximately 2.7 V to 3.6 V, such that the VDDMID output voltage, which is approximately one half of the input supply voltage VDDPST (as described above), may vary within a range of approximately 1.35 V to 1.8 V. Powering the error amplifier 106 via the VDDMID output voltage, rather than the VDDPST input supply voltage, helps to ensure the reliability of the error amplifier 106 and the LDO regulator 100. Specifically, the error amplifier 106 is a 1.8 V device including components (e.g., transistors, etc.) that are not configured to receive voltages in excess of 1.8 V. Thus, by powering the error amplifier 106 via the VDDMID output voltage that varies from 1.35 V to 1.8 V, rather than the VDDPST input supply voltage that varies from 2.7 V to 3.6 V, the reliability of the error amplifier 106 and the LDO regulator 100 is improved by ensuring that the error amplifier 106 does not receive a voltage in excess of 1.8 V.

In conventional LDO regulators, the first power supply terminal 132 of the error amplifier 106 is directly connected to the power supply line 104, such that the error amplifier 106 is powered by the VDDPST input supply voltage. These conventional LDO regulators has low reliability, due to the stress caused by powering the error amplifier 106 with the 2.7 V to 3.6 V VDDPST input supply voltage. The example LDO regulator of FIG. 1 may thus have improved reliability as versus these conventional LDO regulators.

As explained above, the power supply line 104 is coupled to the output node 108 of the LDO regulator 100 via the resistor $R_{DC}$. In the example of FIG. 1, the resistor $R_{DC}$ is a variable resistor, and a resistance value of the resistor $R_{DC}$ is set based on a toggle output of a toggle detector 112. The toggle detector 112 is described in greater detail below with reference to FIG. 5. The toggle detector 112 is configured i) to monitor an output of one or more components included in the SIMC, SDC, and/or eMMC modules 114, and ii) to detect a number of times that the output toggles from high to low and/or low to high. In an example, the number of times is indicative of a net current flow from the modules 114 to the output node 108. Based on this net current flow, the resistance value of the resistor $R_{DC}$ is set to limit an amount of current flowing from the power supply line 104 to the output node 108.

In an example, the SIMC, SDC, and/or eMMC modules 114 includes a plurality of inverters, and the toggle detector 112 monitors an output of one or more of the inverters to detect toggling of the output. Certain inverters of the plurality of inverters sink current to the output node 108, and current is sourced from the output node 108 to other inverters of the plurality of inverters. The toggle detector 112 detects a number of times that the monitored output toggles from high to low and/or low to high, where the number of times is indicative of a difference between the amount of current sunk to the output node 108 and the amount of current sourced from the output node 108. The toggle detector 112 generates the toggle output based on the detected number of times, and the resistance value of the variable resistor $R_{DC}$ is set based on the toggle output. By varying the resistance value of the variable resistor $R_{DC}$ based on the amount of current sunk to the output node 108 and the amount of current sourced from the output node 108, energy from the SIMC, SDC, and/or eMMC modules 114 is recycled (i.e., reused), thus lowering a power consumption of the LDO regulator 100. These aspects of the LDO regulator 100 and toggle detector 112 are described in greater detail below with reference to FIG. 5.

Figure 2:
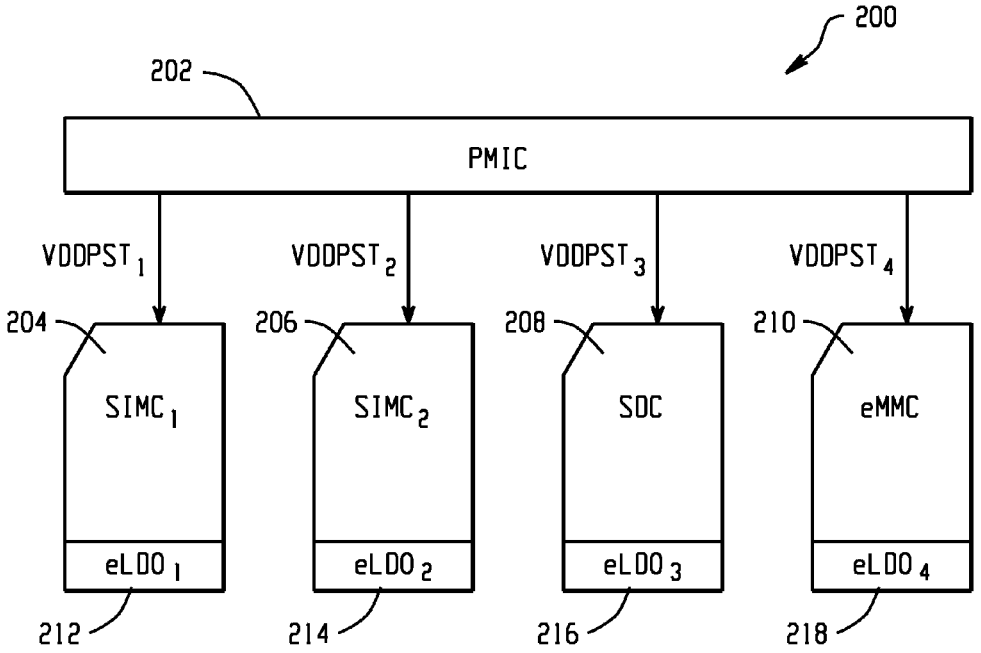
FIG. 2 depicts an example system architecture including a Power Management Integrated Circuit (PMIC) and multiple card interfaces in accordance with some embodiments.

FIG. 2 depicts an example system architecture 200 including a Power Management Integrated Circuit (PMIC) 202 and multiple card interfaces 204, 206, 208, 210, in accordance with some embodiments. The system architecture 200 is used in providing a power supply to multiple different cards. To provide the power supply to the multiple different cards, the system architecture 200 includes the PMIC 202 that is coupled to each of the card interfaces 204, 206, 208, 210. The first and second card interfaces 204, 206 are labeled "$SIMC_1$" and "$SIMC_2$," respectively, and each of these interfaces 204, 206 is used to provide power to a Subscriber Identity Module (SIM) card. The third card interface 208 is labeled "SDC" and is used to provide power to a Secure Digital Card (SDC). The fourth card interface 210 is labeled "eMMC" and is used to provide power to an embedded Multi-Media Card (eMMC). Thus, each of the card interfaces 204, 206, 208, 210 shown in the system architecture 200 is coupled to a card of a particular type. The card interfaces 204, 206, 208, 210 shown in the system architecture 200 are transmission interfaces with a 3.3 V specification for providing 3.3 V to cards.

As illustrated in FIG. 2, each of the card interfaces 204, 206, 208, 210 is configured to receive an input supply voltage from the PMIC 202. Specifically, the $SIMC_1$ card interface 204 receives a $VDDPST_1$ input supply voltage from the PMIC 202, the $SIMC_2$ card interface 206 receives a $VDDPST_2$ input supply voltage, the SDC card interface 210 receives a $VDDPST_3$ input supply voltage, and the eMMC card interface 210 receives a $VDDPST_4$ input supply voltage. Each of the VDDPST input supply voltages is provided via a power supply line that is similar to the power supply line 104 of FIG. 1, and each of these input supply voltages may vary within a range of approximately 2.7 V to 3.6 V.

A low dropout (LDO) regulator is embedded in each of the four card interfaces 204, 206, 208, 210. Thus, as illustrated in the system architecture 200, the $SIMC_1$ card interface 204 includes an $eLDO_1$, the $SIMC_2$ card interface 206 includes an $eLDO_2$, the SDC card interface 208 includes an $eLDO_3$, and the eMMC card interface 210 includes an $eLDO_4$, where "eLDO" represents an "embedded LDO regulator." In each of the four card interfaces 204, 206, 208, 210, the embedded LDO regulator generates a VDDMID voltage based on the received VDDPST input supply voltage. As described above with reference to FIG. 1, the embedded LDO regulators 212, 214, 216, 218 is configured to generate the VDDMID voltage that is equal to approximately one half of the received VDDPST input supply voltage. Thus, with the VDDPST input supply voltage varying within a range of approximately 2.7 V to 3.6 V, the VDDMID voltage may vary within a range of approximately 1.35 V to 1.8 V.

The VDDMID voltage is received by other components included in each of the card interfaces 204, 206, 208, 210. For example, each of the card interfaces 204, 206, 208, 210 illustrated in the system architecture 200 includes a post-driver circuit coupled between the input supply voltage VDDPST and a ground node, and the post-driver circuit receives the VDDMID voltage from the LDO regulator. The receipt of the VDDMID voltage at the post-driver circuit and other components of the card interfaces 204, 206, 208, 210 are described below with reference to FIGS. 3A-3C and 5.

Figure 3A:
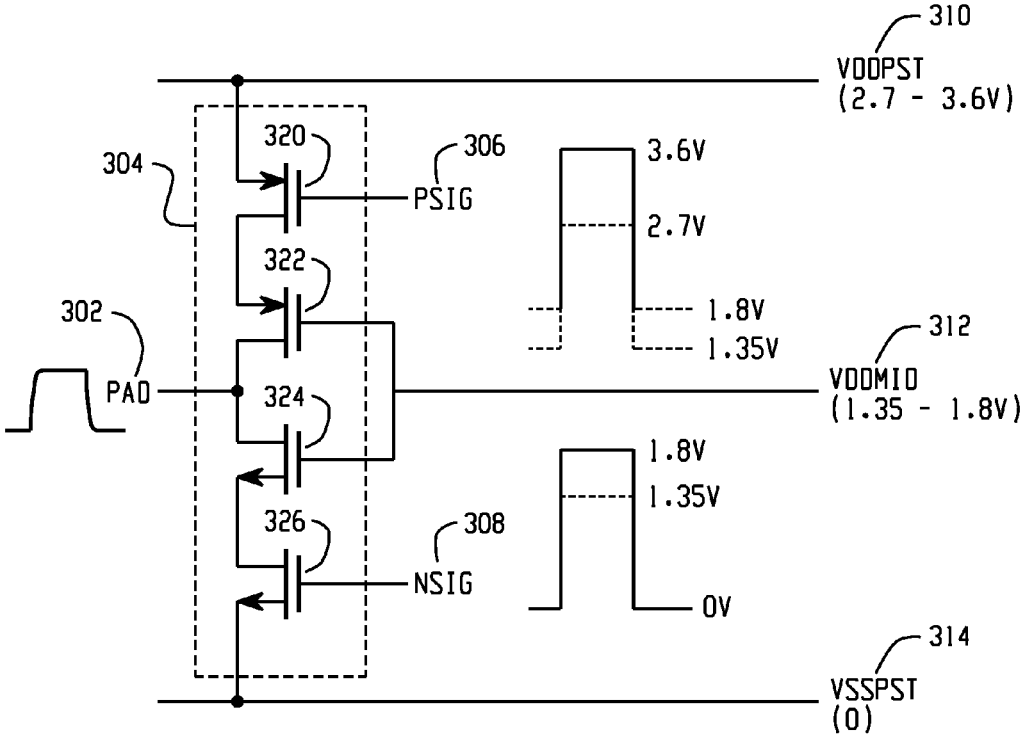
FIG. 3A depicts an example post-driver coupled between a power supply line (VDDPST) and a ground node (VSSPST), in accordance with some embodiments.

FIG. 3A depicts an example post-driver circuit 304 included in a card interface, in accordance with some embodiments. As described above with reference to FIGS. 1 and 2, an LDO regulator is embedded in a card interface and used to generate a 1.35 V to 1.8 V VDDMID voltage that is received by other components in the card interface. In the example of FIG. 3A, the card interface includes the post-driver circuit 304 that is coupled between a power supply line and a ground node. The power supply line is at a VDDPST voltage 310, and the ground node is at a VSSPST voltage 314, which is equal to 0 V. The post-driver circuit 304 is configured to receive a VDDMID voltage 312 that is generated by an LDO regulator embedded in the card interface. The generation of the VDDMID voltage 312 by the LDO regulator is described above with reference to FIG. 1. The post-driver circuit 304 is configured to deliver a large amount of current to drive an output load in a coupled PC board. Such PC boards are known to those of ordinary skill in the art and are not described in detail herein.

The post-driver circuit 304 comprises serially-coupled p-type transistors 320, 322 and serially-coupled n-type transistors 324, 326 coupled in a cascade inverter configuration. A gate of the p-type transistor 320 receives a first drive signal 306, "PSIG," and a gate of the n-type transistor 326 receives a second drive signal 308, "NSIG." The gate electrodes of the p-type transistor 322 and the n-type transistor 324 is coupled to the VDDMID voltage 312 that is generated by the LDO regulator embedded in the card interface. A "PAD" output signal 302 is generated by the post-driver circuit 304 based on the received VDDMID voltage 312, PSIG drive signal 306, and NSIG drive signal 308. As illustrated in FIG. 3A, the PAD output signal 302 is provided at a common node coupled to a drain of the p-type transistor 322 and to a drain of the n-type transistor 324. The PAD output signal 302 may swing between 0 V and approximately 3.6 V. The PAD output signal is used in providing communications between SIMC, SDC, and/or eMMC modules and the aforementioned PC board.

As described above with reference to FIG. 1, the VDDPST voltage 310 may vary within a range of approximately 2.7 V to 3.6 V, and the embedded LDO regulator generates the VDDMID voltage 312 that is approximately one half of the VDDPST voltage 310, varying within a range of approximately 1.35 V to 1.8 V. FIG. 3A illustrates that a maximum voltage differential (i.e., voltage swing) between the VDDPST voltage 310 and the VDDMID voltage 312 is equal to 1.8 V (i.e., the maximum voltage differential of 1.8 V exists when the VDDPST voltage 310 is equal to 3.6 V and the VDDMID voltage 312 is equal to 1.8 V). When this 1.8 V voltage differential exists between the VDDPST and VDDMID voltages 310, 312, a 1.8 V voltage differential also exists between the VDDMID voltage 312 and the VSSPST voltage 314.

FIG. 3A further illustrates that a minimum voltage differential between the VDDPST voltage 310 and the VDDMID voltage 312 is equal to 1.35 V (i.e., the minimum voltage differential of 1.35 V exists when the VDDPST voltage 310 is equal to 2.7 V and the VDDMID voltage 312 is equal to 1.35 V). When this 1.35 V voltage differential exists between the VDDPST and VDDMID voltages 310, 312, a 1.35 V voltage differential also exists between the VDDMID voltage 312 and the VSSPST voltage 314. Thus, it should be appreciated that at any VDDPST voltage 310, a voltage differential existing between the VDDPST and VDDMID voltages 310, 312 is approximately equal to a voltage differential existing between the VDDMID and VSSPST voltages 312, 314. These voltage differentials is approximately equal due to the use of the embedded LDO regulator, which generates the VDDMID voltage 312 that tracks the VDDPST voltage 310 at half-voltage, as described above.

The use of VDDPST/VDDMID and VDDMID/VSSPST voltage differentials that are approximately equal may allow components of the post-driver 304 to be fabricated in a more compact manner. The post-driver 304 includes both PMOS components (i.e., p-type transistors 320, 322) and NMOS components (i.e., n-type transistors 324, 326). If the voltage differential between the VDDPST and VDDMID voltages 310, 312 varies significantly from the voltage differential between the VDDMID and VSSPST voltages 312, 314, then it is required to fabricate the PMOS components of the post-driver circuit 304 to have a size that is significantly greater than that of the NMOS components. Conversely, if the voltage differential between the VDDPST and VDDMID voltages 310, 312 is approximately equal to the voltage differential between the VDDMID and VSSPST voltages 312, 314, then the PMOS components of the post-driver circuit 304 is fabricated to have a size that is comparable to that of the NMOS components.

Figure 3B:
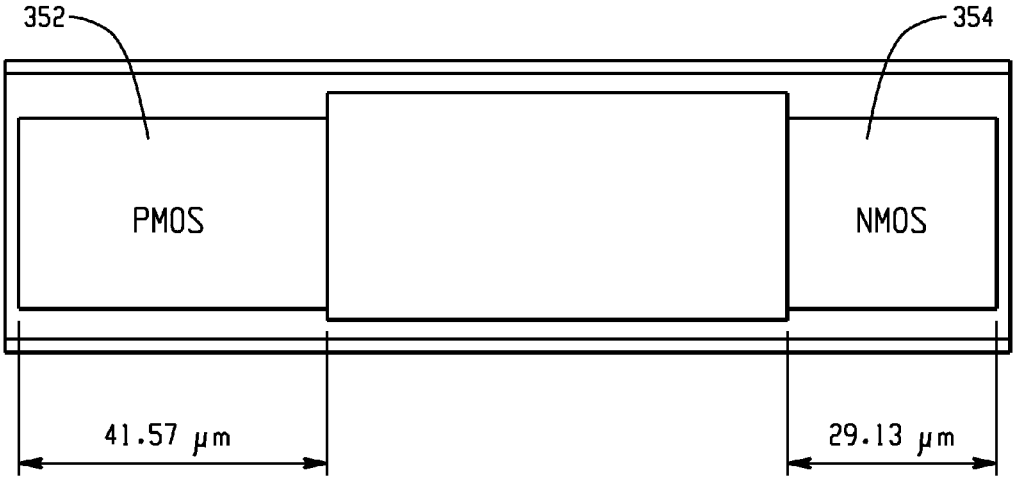
FIG. 3B depicts dimensions of PMOS and NMOS components for the example post-driver of FIG. 3A, in accordance with some embodiments.

FIG. 3B depicts example dimensions of PMOS and NMOS components 352, 354, respectively, for the example post-driver 304 of FIG. 3A, in accordance with some embodiments. Because the voltage differential between the VDDPST and VDDMID voltages 310, 312 is approximately equal to the voltage differential between the VDDMID and VSSPST voltages 312, 314, in the example of FIG. 3A, the PMOS components 352 have a dimension (e.g., a length) that is equal to 41.57 μm. The 41.57 μm dimension of the PMOS components 352 is comparable to a corresponding dimension of the NMOS components 354 that is equal to 29.13 μm. It should be understood that these dimensions are only examples and that the PMOS and NMOS components has other dimensions in other examples. For purposes of FIG. 3B, it should be understood that the size of the PMOS components 352 is comparable to that of the NMOS components 354, and that these comparable sizes is facilitated by causing the voltage differentials described above to be approximately equal.

In a conventional card interface lacking the embedded LDO regulator described herein, the VDDMID voltage 312 received by the post-driver circuit 304 is a constant voltage that is independent of the VDDPST voltage 310. In an example conventional card interface, the VDDMID voltage 312 is a constant 1.8 V. In this example, with the VDDPST voltage 310 varying within the range of approximately 2.7 V to 3.6 V, a maximum voltage differential between the VDDPST voltage 310 and the constant VDDMID voltage 312 is equal to 1.8 V (i.e., the maximum voltage differential of 1.8 V exists when the VDDPST voltage 310 is equal to 3.6 V). When this 1.8 V voltage differential exists between the VDDPST and VDDMID voltages, a 1.8 V voltage differential exists between the constant VDDMID voltage 312 and the VSSPST voltage 314. A minimum voltage differential between the VDDPST voltage 310 and the constant VDDMID voltage 312 is equal to 0.9 V (i.e., the minimum voltage differential of 0.9 V exists when the VDDPST voltage 310 is equal to 2.7 V). When this 0.9 V voltage differential exists between the VDDPST and VDDMID voltages 310, 312, a 1.8 V voltage differential exists between the constant VDDMID voltage 312 and the VSSPST voltage 314.

The discussion above illustrates that in the conventional card interface lacking the embedded LDO regulator described herein, a voltage differential existing between the VDDPST and VDDMID voltages 310, 312 is significantly different than a voltage differential existing between the VDDMID and VSSPST voltages 312, 314. Because of these differing voltage differentials in the conventional card interface, it is required to fabricate the PMOS components of the post-driver circuit 304 to have a dimension (e.g., a length) that is longer than the 41.57 μm dimension illustrated in FIG. 3B. For example, the PMOS components of the conventional card interface has a larger length dimension that is equal to 52.22 μm. In the conventional card interface, the NMOS components of the post-driver circuit 304 has a length dimension that is equal to 28.58 μm, for example.

It should thus be appreciated that using the embedded LDO regulator of FIGS. 1 and 2 to generate the VDDMID voltage 312 that tracks the VDDPST voltage 310 at half-voltage allows the post-driver circuit 304 to be fabricated with PMOS and NMOS components that are more balanced in size, as compared to the above-described conventional card interface. When the PMOS and NMOS components of the post-driver circuit 304 are less balanced in size, the PAD output signal 302 suffers from an unbalanced rise/fall propagation delay. Conversely, when using the embedded LDO regulator described herein to achieve the PMOS and NMOS components that are more balanced in size, the PAD output signal 302 has a rise/fall propagation delay that is more balanced.

Figure 3C:
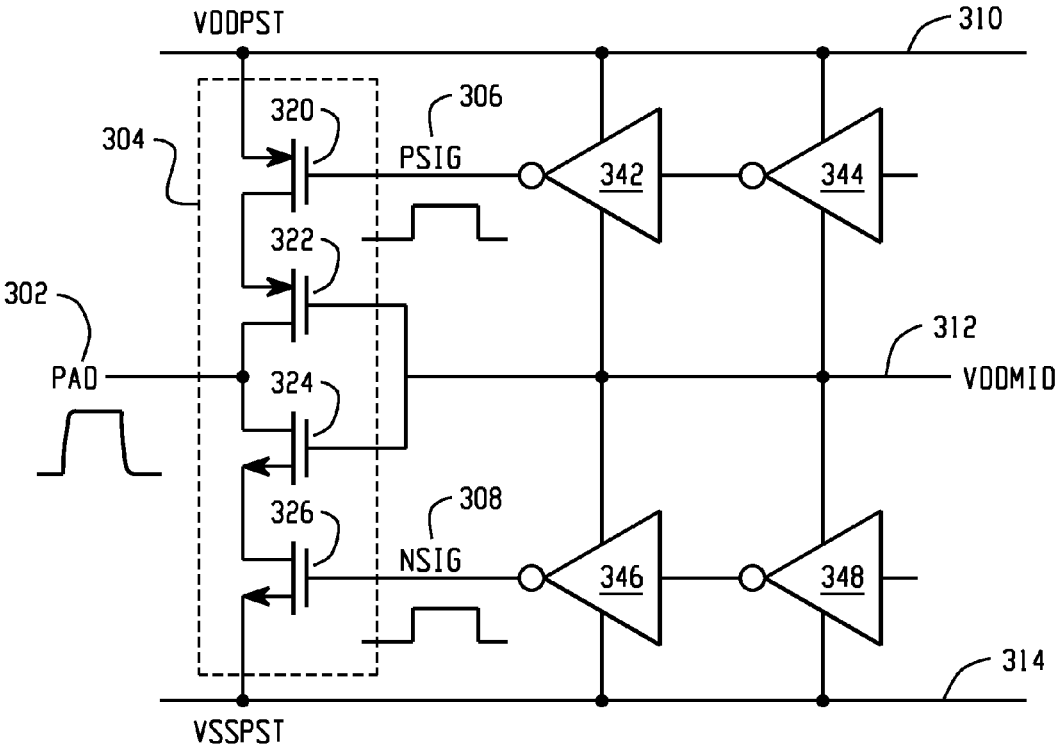
FIG. 3C depicts serially-coupled inverters used in generating the PSIG and NSIG drive signals received at the example post-driver.

FIG. 3C depicts serially-coupled inverters 342, 344 used in generating the PSIG drive signal 306 and serially-coupled inverters 346, 348 used in generating the NSIG drive signal 308 received at the example post-driver 304. As explained above with reference to FIG. 3A, the gate of the p-type transistor 320 receives a PSIG drive signal 306, and the gate of the n-type transistor 326 receives an NSIG drive signal 308. The PAD output signal 302 is generated by the post-driver circuit 304 based on the received VDDMID voltage 312, PSIG drive signal 306, and NSIG drive signal 308.

The circuit of FIG. 3C expands on the circuit of FIG. 3A by illustrating a source of the PSIG and NSIG drive signals 306, 308. Specifically, as shown in FIG. 3C, the PSIG drive signal 306 is received at the post-driver circuit 304 via first and second serially-coupled inverters 342, 344 that are included in the card interface. Each of the first and second serially-coupled inverters 342, 344 is coupled between the VDDPST voltage 310 and the VDDMID voltage 312. The NSIG drive signal 308 is received at the post-driver circuit 304 via third and fourth serially-coupled inverters 346, 348 that are included in the card interface. Each of the third and fourth serially-coupled inverters 346, 348 is coupled between the VDDMID voltage 312 and the VSSPST voltage 314.

Coupling the first and second serially-coupled inverters 342, 344 between the VDDPST voltage 310 and the VDDMID voltage 312 causes a ground reference voltage of these inverters 342, 344 to be equal to the VDDMID voltage 312. Coupling the first and second serially-coupled inverters 342, 344 between the voltages 310, 312 helps to ensure the reliability of the inverters 342, 344. Specifically, the inverters 342, 344 is 1.8 V devices including components (e.g., transistors, etc.) that are not configured to receive voltages in excess of 1.8 V. Thus, by setting the ground reference voltage of the inverters 342, 344 equal to the VDDMID voltage 312, rather than 0 V, the reliability of the inverters 342, 344 is improved by ensuring that the inverters 342, 344 do not receive a voltage in excess of 1.8 V. In a similar manner, coupling the third and fourth serially-coupled inverters 346, 348 between the VDDMID voltage 312 and the VSSPST voltage 314 as illustrated in FIG. 3C ensures that the inverters 346, 348 do not receive a voltage in excess of 1.8 V, thus helping to ensure the reliability of these inverters 346, 348.

Figure 4:
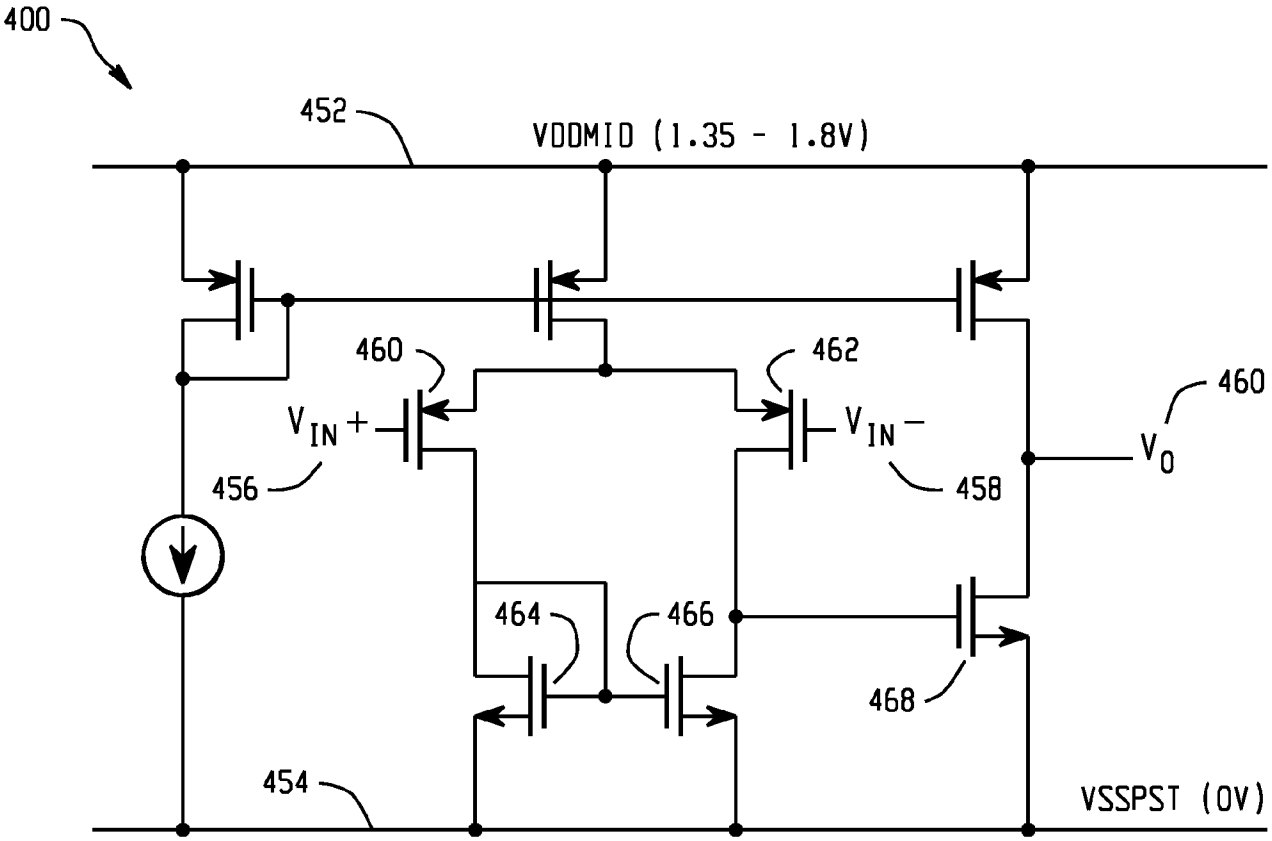
FIG. 4 is a schematic depicting components of an example error amplifier, in accordance with some embodiments.

FIG. 4 is a circuit schematic depicting components of an example error amplifier 400, in accordance with some embodiments. As described above with reference to FIG. 1, an embedded LDO regulator includes an error amplifier. The error amplifier has a single-ended output that is configured to drive a pass transistor to an appropriate operating point to generate a 1.35 V-1.8 V VDDMID voltage that is approximately one half of a 2.7 V-3.6 V VDDPST input supply voltage. Further, the error amplifier includes a first power supply terminal that is connected to the VDDMID voltage and a second power supply terminal that is connected to a VSSPST ground voltage.

The example error amplifier 400 of FIG. 4 is used in the embedded LDO regulator 100 described above with reference to FIG. 1. In FIG. 4, a first voltage rail 452 has a voltage of 1.35 V-1.8 V, as dictated by the VDDMID voltage received at the first power supply terminal. A second voltage rail 454 has a voltage of 0 V, as dictated by the connection of the second power supply terminal to the ground voltage. It should thus be appreciated that the error amplifier 400 of FIG. 4 is powered by the 1.35 V-1.8 V VDDMID voltage and has a ground reference voltage of 0 V, thus ensuring that components included in the error amplifier 400 do not receive a voltage in excess of 1.8 V.

An error signal $V_o$ 460 is an output of the error amplifier 400 that is generated based on a difference between a Vin(+) input signal 456 and a Vin(−) input signal 458. In generating the error signal $V_o$ 460, the Vin(+) input signal 456 is received at a gate terminal of a first p-type transistor 460 that is serially-coupled to a first n-type transistor 464. The Vin(−) input signal 458 is received at a gate terminal of a second p-type transistor 462 that is serially-coupled to a second n-type transistor 466. This configuration of transistors generates an intermediate error signal that indicates a difference between the Vin(+) input signal 456 and the Vin(−) input signal 458. The intermediate error signal is received at a gate of a third n-type transistor 468. The third n-type transistor 468 amplifies this intermediate error signal to generate the error signal $V_o$ 460.

Figure 5:
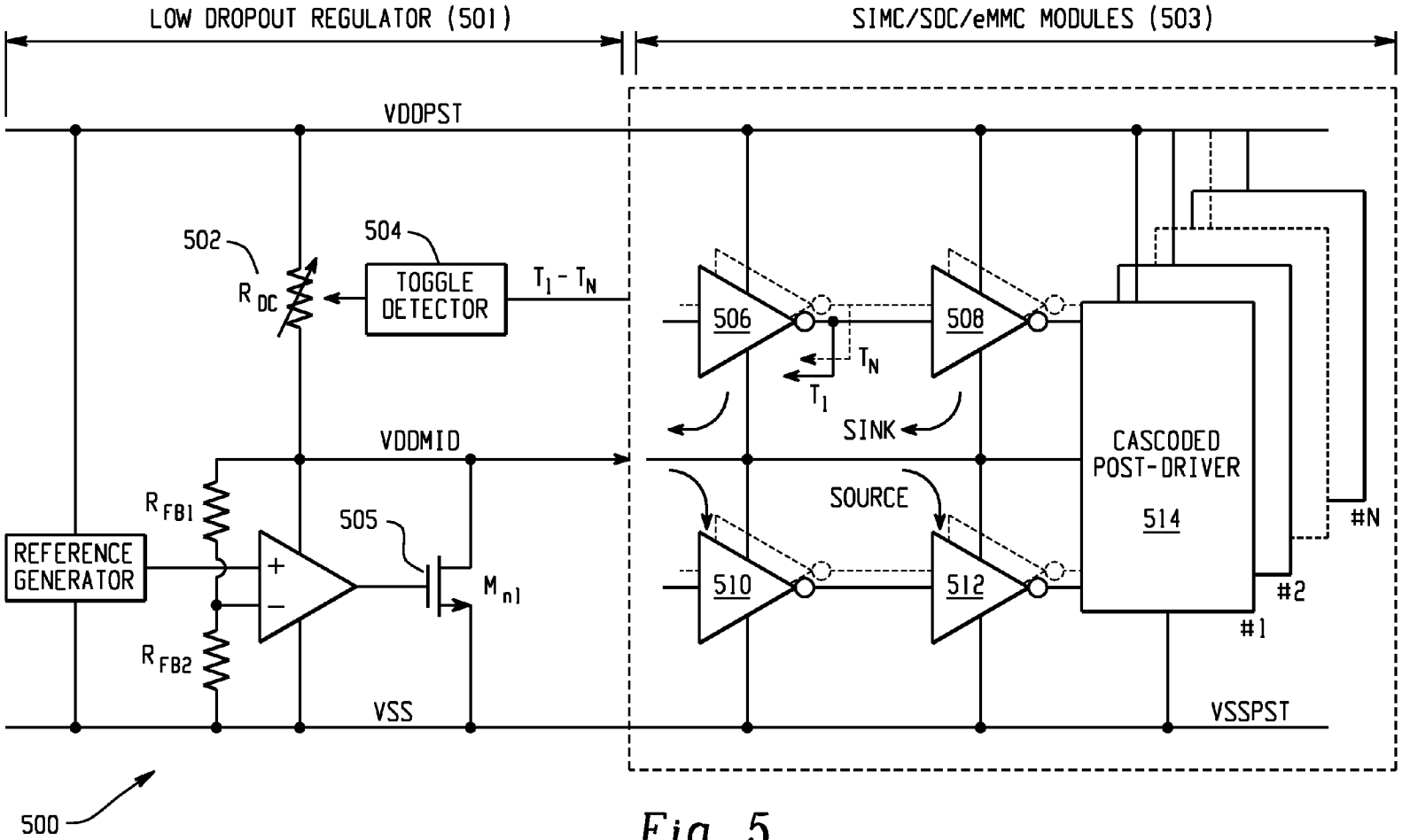
FIG. 5 depicts example features of a card interface, where the card interface includes an LDO regulator and SIMC, SDC, and/or eMMC modules, in accordance with some embodiments.

FIG. 5 depicts example features of a card interface 500, where the card interface 500 includes an LDO regulator 501 and SIMC, SDC, and/or eMMC modules 503, in accordance with some embodiments. The LDO regulator 501 is embedded in the card interface 500 and includes components similar to those described above with reference to FIG. 1. For brevity, the description of these components is not repeated here. The SIMC, SDC, and/or eMMC modules 503 included in the card interface 500 includes a post-driver circuit 512 that is coupled between a 2.7 V-3.6 V VDDPST power supply line and a 0 V VSSPST ground node. The post-driver circuit 512 is configured to receive i) a 1.35 V-1.8 V VDDMID output voltage generated by the LDO regulator 501, ii) a PSIG drive signal, and iii) an NSIG drive signal. The receipt of the PSIG and NSIG drive signals at the post-driver circuit is illustrated in FIGS. 3A and 3C and described above with reference to these figures. The post-driver circuit 512 is configured to generate a PAD output signal based on these inputs.

The SIMC, SDC, and/or eMMC modules 503 included in the card interface 500 further includes first and second serially-coupled inverters 506, 508 that are coupled between the VDDPST power supply line and the VDDMID output node of the LDO regulator 501. The PSIG drive signal is received at the post-driver circuit 512 from the first and second serially-coupled inverters 506, 508. The modules 503 includes third and fourth serially-coupled inverters 510, 512 that are coupled between the VDDMID output node of the LDO regulator 501 and the VSSPST ground node. The NSIG drive signal is received at the post-driver circuit 512 from the third and fourth serially-coupled inverters 510, 512.

Although the SIMC, SDC, and/or eMMC modules 503 included in the card interface 500 are described herein with reference to a single post-driver circuit 512, a single first inverter 506, a single second inverter 508, a single third inverter 510, and a single fourth inverter 512, it should be understood that the modules 503 includes a plurality post-driver circuits with connections as illustrated in FIG. 5. Thus, FIG. 5 shows cascoded post-driver circuits 1, 2, . . . N, where each of the N post-driver circuits are connected to at least the VDDPST power supply line, the VDDMID output node, the VSSPST ground node, and four inverters for receiving the PSIG and NSIG drive signals.

The LDO regulator 501 includes a variable resistor 502 that couples the VDDPST power supply line to the VDDMID output node. A resistance value of the variable resistor 502 is set based on i) an amount of current sunk from the first and second serially-coupled inverters 506, 508 to the VDDMID output node, and ii) an amount of current sourced from the VDDMID output node to the third and fourth serially-coupled inverters 510, 512. To set the resistance value of the variable resistor 502 based on these values, the LDO regulator 501 includes a toggle detector 504 that detects a number of times an output of the first inverter 506 toggles from high to low and/or low to high. The number of times is indicative of a difference between the amount of current sunk and the amount of current sourced. The toggle detector 504 generates a toggle output based on the detected number of times, and the resistance value of the variable resistor 502 is set based on the toggle output.

To illustrate these features of the card interface 500 involving the toggle detector 504, FIG. 5 shows that the toggle detector 504 receives the output $T_1$ of the first inverter 506. Other first inverters coupled to post-driver circuits 2 . . . N similarly generates outputs $T_2$ . . . $T_N$ that are received at the toggle detector 504. FIG. 5 also shows paths by which the first and second serially-coupled inverters 506, 508 sink current to the VDDMID output node and paths by which the VDDMID output node sources current to the third and fourth serially-coupled inverters 510, 512. Current is sunk from the first and second serially-coupled inverters 506, 508 to the VDDMID output node when the outputs of these inverters 506, 508 are toggling from low to high and/or high to low. Likewise, current is sourced from the VDDMID output node to the third and fourth serially-coupled inverters 510, 512 when the outputs of these inverters 510, 512 are toggling from low to high and/or high to low.

In an example, if outputs of all of the inverters 506, 508, 510, 512 are toggling at approximately the same time, an amount of current sunk from the first and second inverters 506, 508 is greater than an amount of current sourced to the third and fourth inverters 510, 512. This is because the first and second inverters 506, 508 are larger in size than the third and fourth inverters 510, 512. Because outputs of all four of the inverters 506, 508, 510, 512 is configured to toggle at approximately the same time, it is sufficient for the toggle detector 504 to only monitor the output of the first inverter 506 (i.e., if the output of the first inverter 506 is toggling, then the toggle detector 504 generates its toggle output based on the understanding that the outputs of all four of the inverters 506, 508, 510, 512 are toggling and thus causing the corresponding sinking and sourcing of current).

As illustrated from the discussion above, when an output of the first inverter 506 is determined to be toggling, the outputs of all of the inverters 506, 508, 510, 512 is toggling, and this causes a net current flow into the VDDMID output node. The net current flow is "recycled" in the LDO regulator 501 in order to lower a current consumption in the card interface 500. Specifically, the toggle detector 504 detects the number of times that the first inverter 506 toggles from high to low and/or low to high to determine the amount by which the current sunk from the inverters 506, 508 to the VDDMID output node exceeds the current sourced from the VDDMID output node to the inverters 510, 512. The VDDMID output node is charged with extra energy due to the net current flow into this node. Based on the net current flow into the VDDMID output node and the extra energy at this node, a resistance value of the variable resistor 502 is increased to restrict current flowing between the VDDPST power supply line and the VDDMID output node. Restricting this current flow helps to ensure that the extra energy present at the VDDMID output node is not discharged through pass transistor 505. Thus, the extra energy from the modules 503 is used and not wasted.

Figure 6:
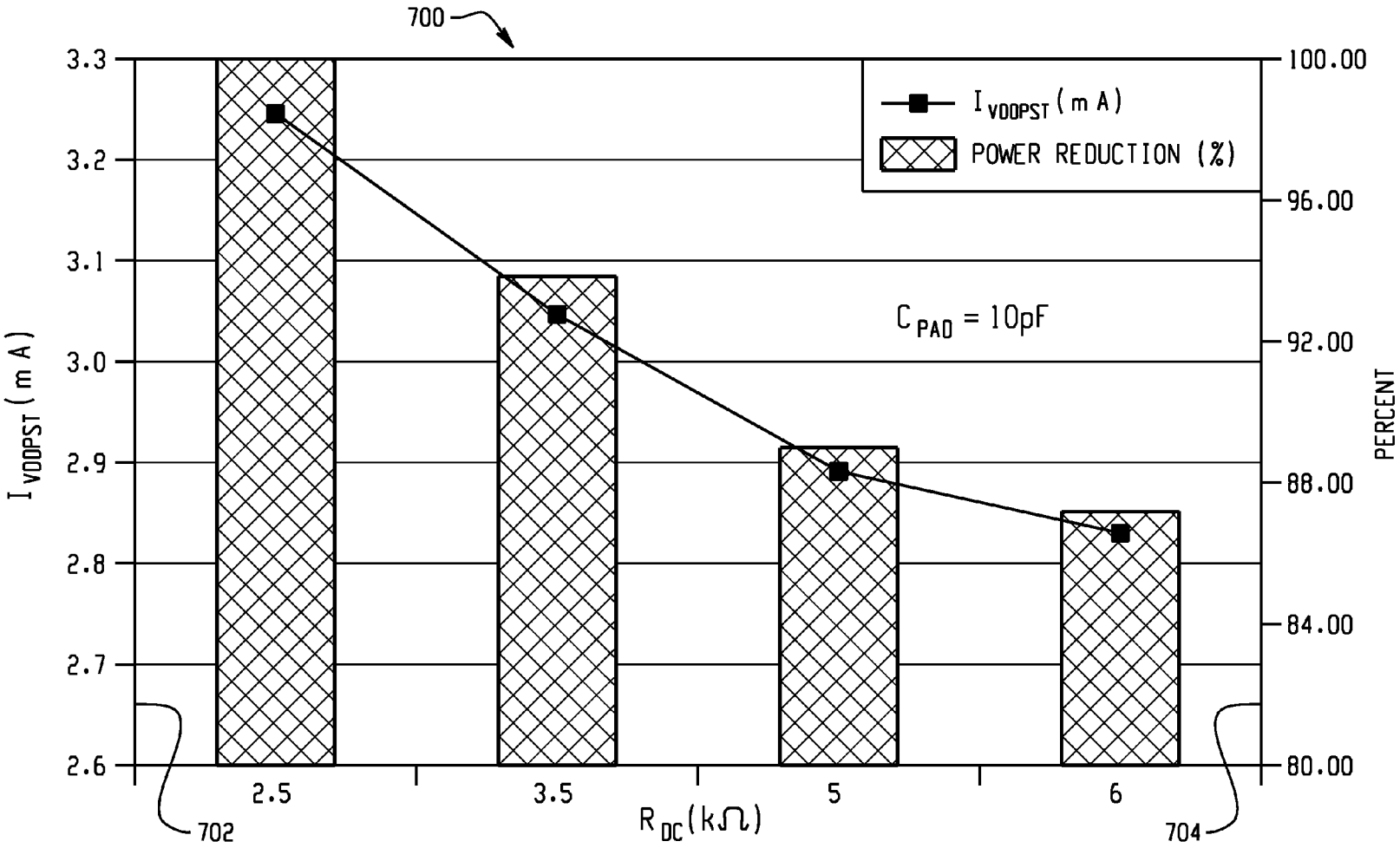
FIG. 6 is a graph illustrating a reduction in current consumption of an LDO regulator with increasing resistance values for a variable resistor, in accordance with some embodiments.

FIG. 6 depicts a graph 700 illustrating a reduction in current consumption in the card interface 500 that is achieved by recycling energy from the modules 503 and varying the resistance value of the variable resistor 502. In FIG. 6, an x-axis represents the resistance value of the variable resistor 502 in kilohms (kΩ), a first y-axis 702 represents current from the VDDPST power supply line that is consumed in the card interface 500 in milliamperes (mA), and a second y-axis 704 represents a reduction in power consumed in the card interface 500 in percentage.

As illustrated in the graph 700, with increasing resistance values, an amount of current consumed from the VDDPST power supply line is decreased. As described above with reference to FIG. 5, when the amount of current sunk from the first and second inverters 506, 508 to the VDDMID output node exceeds the amount of current sourced from the VDDMID output node to the third and fourth inverters 510, 512, the toggle detector 504 increases the resistance value of the variable resistor 502 to limit the current flowing from the VDDPST power supply line to the VDDMID output node. This decreases the amount of current from the VDDPST power supply line that is consumed in the card interface 500. Consistent with this reduction of consumed current, the power consumed in the card interface 500 also decreases, as illustrated in FIG. 6.

Figure 7:
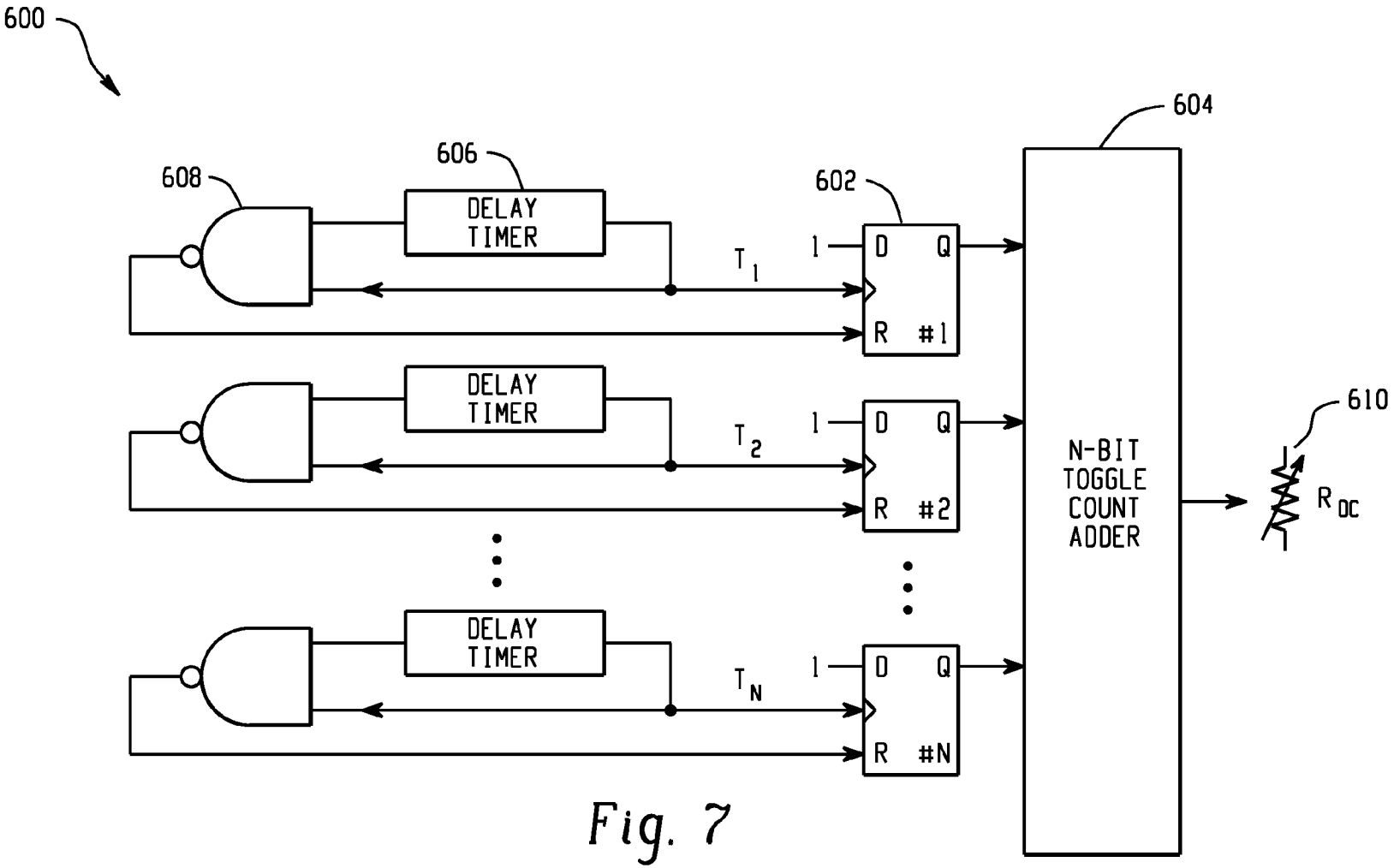
FIG. 7 depicts an example toggle detector, in accordance with some embodiments.

FIG. 7 depicts an example toggle detector 600, in accordance with some embodiments. The toggle detector 600 of FIG. 7 is used within the context of the card interface 500 of FIG. 5 to detect toggling in the output of one or more of the inverters 506, 508, 510, 512. As illustrated in FIG. 7, the toggle detector 600 includes a D-type flip-flop 602 that includes a clock input as denoted by the chevron or arrow (">"). The D-type flip-flop 602 is configured to receive an output $T_1$ of a first inverter (e.g., the first inverter 506 of FIG. 5) on the clock input. The D-type flip-flop 602 of FIG. 7 is positive edge-triggered, such that data on a "D" input pin of the flip-flop 602 is output to the "Q" output pin when a rising clock edge is received at the clock input.

The "Q" output pin of the D-type flip-flop 602 is coupled to an N-bit toggle count adder 604. The output of the D-type flip-flip 602 is configured to be at a first logic level (e.g., a high logic level) during a period of time in which the output $T_1$ of the first inverter is toggling from high to low and/or low to high. Conversely, the output of the D-type flip-flop 602 is configured to be at a second, different logic level (e.g., a low logic level) during a period of time in which the output $T_1$ of the first inverter is not toggling.

The N-bit toggle count adder 604 receives such logic level high and logic level low signals from the D-type flip-flop 602, and based on these signals, the N-bit toggle count adder 604 is configured to determine the number of times that the output $T_1$ of the first inverter toggles from high to low and/or low to high. The N-bit toggle count adder 604 generates a toggle output of the toggle detector 600 based on the determined number of times, and a resistance value of a variable resistor 610 is set based on the toggle output. It should be understood that the variable resistor 610 is used within the context of the card interface 500 of FIG. 5, for example, as the variable resistor $R_{DC}$ 502 coupled between the VDDPST power supply line and the VDDMID output node.

To allow the D-type flip-flop 602 to output the first logic level signal during periods of time in which the output $T_1$ is toggling and to output the second logic level signal during periods of time in which the output $T_1$ is not toggling, the toggle detector 602 includes a delay timer 606 and a NAND gate 608. As illustrated in FIG. 7, the NAND gate 608 has two inputs. On a first input of the NAND gate 608, the NAND gate 608 receives directly the output $T_1$ of the first inverter. On a second input of the NAND gate 608, the NAND gate 608 receives the output $T_1$ of the first inverter after the output $T_1$ is passed through the delay timer 606. The delay timer 606 is a delay element that delays the propagation of the output $T_1$ for a period of time.

The NAND gate 608 performs a "NAND" operation based on the two received inputs, and an output of the NAND gate 608 is indicative of whether the output $T_1$ is toggling or not. The output of the NAND gate 608 is received at an "R" reset pin of the D-type flip-flop 602. Specifically, when the output $T_1$ stops toggling for an amount of time defined by the delay timer 606, the NAND gate 608 generates the output received at the "R" reset pin that resets the D-type flip-flop 602 and causes the output of the D-type flip-flop 602 to be at the second logic level (e.g., low). Otherwise, if the output $T_1$ has not stopped toggling for the amount of time defined by the delay timer 606, the NAND gate 608 generates an output that does not reset the D-type flip-flop 602, and the D-type flip-flop 602 continues to output a first logic level (e.g., high) signal.

As explained above with reference to FIG. 5, the card interface 500 includes a plurality of post-driver circuits 1, 2, . . . N, with each of the post-driver circuits being coupled to a plurality of inverters. Consequently, the toggle detector 600 of FIG. 7 includes N D-type flip-flops, N delay timers, and N NAND gates, where N is greater than one. Each grouping of components receives a single output signal of the output signals $T_1 \ldots T_N$ and determine if the received output signal is toggling, where a grouping of components includes a D-type flip flop, a delay timer, and a NAND gate. Each of the N D-type flip-flops generates an output signal received at the N-bit toggle count adder 604.

The present disclosure is directed to a low dropout regulator. As described above, a circuit comprising the low dropout regulator includes an error amplifier that is powered based on an output voltage of the low dropout regulator. The low dropout regulator described herein generates the output voltage that tracks an input supply voltage, such that fluctuations in the input supply voltage cause the output voltage of the low dropout regulator to vary in a similar manner. Specifically, as described above, the output voltage of the low dropout regulator is varied such that the output voltage is equal to approximately one half of the input supply voltage. The low dropout regulator described herein also includes a variable resistor that can be tuned to lower a power consumed in the regulator. The tuning of the variable resistor is based on a net current flow received at an output node of the low dropout regulator.

The present disclosure is directed to a low dropout regulator and a system for supplying power to a card. In an embodiment of a low dropout regulator, the low dropout regulator includes a reference voltage supply circuit configured to output a reference voltage based on an input supply voltage received from a power supply line. Changes in the input supply voltage cause the reference voltage to change. The low dropout regulator also includes an error amplifier having a first input, a second input, and a single-ended output. The first input is coupled to the reference voltage, and the second input is coupled to an output node of the low dropout regulator via a first feedback resistor. The low dropout regulator further includes a pass transistor including a control electrode connected to the single-ended output of the error amplifier, a first electrode connected to a ground node, and a second electrode connected to the output node of the low dropout regulator. A first power supply terminal of the error amplifier is connected to the output node, and the output node provides an output voltage of the low dropout regulator that powers the error amplifier.

Another embodiment of a low dropout regulator includes a reference voltage supply circuit configured to output a reference voltage based on an input supply voltage received from a power supply line. An increase in the input supply voltage causes the reference voltage to increase, and a decrease in the input supply voltage causes the reference voltage to decrease. The low dropout regulator also includes an error amplifier having a first input, a second input, and a single-ended output. The first input is connected to the reference voltage, and the second input is coupled to i) an output node of the low dropout regulator via a first feedback resistor, and ii) a ground node via a second feedback resistor. The low dropout regulator further includes an n-type MOS transistor including a gate terminal connected to the single-ended output of the error amplifier, a source terminal connected to the ground node, and a drain terminal connected to the output node of the low dropout regulator. A resistor is coupled between the power supply line and the output node. A power supply terminal of the error amplifier is connected to the output node, where the output node provides an output voltage of the low dropout regulator that powers the error amplifier. The error amplifier is configured to drive the n-type MOS transistor to an operating point that causes the output voltage to be approximately one half of the input supply voltage.

In an embodiment of a system for supplying power to a card, the system includes a power management integrated circuit (PMIC) and a card interface. The card interface is configured to receive an input supply voltage from the PMIC, and the card interface includes a low dropout regulator. The low dropout regulator includes a reference voltage supply circuit configured to output a reference voltage based on an input supply voltage received from a power supply line. Changes in the input supply voltage cause the reference voltage to change. The low dropout regulator also includes an error amplifier having a first input, a second input, and a single-ended output. The first input is coupled to the reference voltage, and the second input is coupled to an output node of the low dropout regulator via a first feedback resistor. The low dropout regulator further includes a pass transistor including a control electrode connected to the single-ended output of the error amplifier, a first electrode connected to a ground node, and a second electrode connected to the output node of the low dropout regulator. A first power supply terminal of the error amplifier is connected to the output node, and the output node provides an output voltage of the low dropout regulator that powers the error amplifier.

The foregoing outlines features of several embodiments so that those skilled in the art is better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A low dropout regulator for providing an output voltage, the low dropout regulator comprising:

a power supply line;

a reference voltage supply circuit coupled to the power supply line and configured to receive an input supply voltage from the power supply line, the reference voltage supply circuit outputting a reference voltage based on the input supply voltage, wherein changes in the input supply voltage cause the reference voltage to change;

an error amplifier having a first input, a second input, and a single-ended output, wherein the first input is coupled to the reference voltage, and the second input is coupled to an output node of the low dropout regulator via a first feedback resistor;

a pass transistor including a control electrode coupled to the single-ended output of the error amplifier, a first electrode coupled to a ground node, and a second electrode coupled to the output node of the low dropout regulator; and a variable resistor coupled between the power supply line and the output node, wherein a resistance value of the variable resistor is set based on an amount of current sunk from first inverters to the output node, the first inverters being coupled between the power supply line and the output node, and wherein a first power supply terminal of the error amplifier is coupled to the output node, the output node providing an output voltage of the low dropout regulator that powers the error amplifier.

2. The low dropout regulator of claim 1, wherein a second power supply terminal of the error amplifier is coupled to the ground node, wherein the power supply line is coupled to the output node via a resistor, wherein the second input is coupled to the ground node via a second feedback resistor, wherein a voltage present at the second input is a fraction of the output voltage determined based on a ratio of resistance values of the first feedback resistor and the second feedback resistor, and wherein the error amplifier is configured to drive the pass transistor to an operating point that causes the output voltage at the output node to be approximately one half of the input supply voltage.

3. The low dropout regulator of claim 1, wherein the power supply line is coupled to the output node via a resistor, and wherein the first power supply terminal of the error amplifier is not directly coupled to the power supply line.

4. The low dropout regulator of claim 1, wherein the low dropout regulator is embedded in a card interface, the card interface including the first inverters.

5. The low dropout regulator of claim 4, wherein the card interface further includes second inverters coupled between the output node and the ground node, and wherein the resistance value of the variable resistor is set based on an amount of current sourced from the output node to the second inverters.

6. The low dropout regulator of claim 4, wherein the card interface is configured to be coupled to a Subscriber Identity Module (SIM) card, a Secure Digital Card, or an Embedded Multi-Media Card.

7. The low dropout regulator of claim 1, wherein an increase in the input supply voltage causes the reference voltage to increase, and a decrease in the input supply voltage causes the reference voltage to decrease, wherein the changes in the input supply voltage cause the output voltage of the low dropout regulator to change, wherein the increase in the input supply voltage causes the output voltage to increase, and wherein the decrease in the input supply voltage causes the output voltage to decrease.

8. The low dropout regulator of claim 1, wherein the changes in the input supply voltage cause the output voltage of the low dropout regulator to change, and wherein the output voltage is equal to approximately one half of the input supply voltage.

9. The low dropout regulator of claim 7, wherein the changes cause the input supply voltage to vary within a range of approximately 2.7 V to 3.6 V, and wherein the changes cause the output voltage of the low dropout regulator to vary within a range of approximately 1.35 V to 1.8 V.

10. The low dropout regulator of claim 1, wherein the pass transistor is an n-type MOS transistor, wherein the control electrode is a gate terminal of the n-type MOS transistor, wherein the first electrode is a source terminal of the n-type MOS transistor, and wherein the second electrode is a drain terminal of the n-type MOS transistor.

11. The low dropout regulator of claim 1, wherein the low dropout regulator is embedded in a card interface, the card interface including a post-driver circuit coupled between the power supply line and the ground node, wherein the post-driver circuit is configured to receive i) the output voltage of the low dropout regulator, ii) a first drive signal, and iii) a second drive signal, and wherein the post-driver circuit is configured to generate a PAD output signal based on the output voltage of the low dropout regulator, the first drive signal, and the second drive signal.

12. The low dropout regulator of claim 11, wherein the first inverters include first and second serially-coupled inverters, wherein the first drive signal is received at the post-driver circuit via the first and second serially-coupled inverters, each of the first and second serially-coupled inverters being coupled between the power supply line and the output node of the low dropout regulator, wherein the second drive signal is received at the post-driver circuit via third and fourth serially-coupled inverters, each of the third and fourth serially-coupled inverters being coupled between the output node of the low dropout regulator and the ground node, wherein the resistance value of the variable resistor is set based on i) an amount of current sunk from the first and second serially-coupled inverters to the output node, and ii) an amount of current sourced from the output node to the third and fourth serially-coupled inverters.

13. The low dropout regulator of claim 12 comprising:

a toggle detector that detects a number of times that an output of the first inverter toggles from high to low or low to high, wherein the number of times is indicative of a difference between the amount of current sunk and the amount of current sourced, and wherein the toggle detector generates a toggle output based on the detected number of times, the resistance value of the variable resistor being set based on the toggle output.

14. The low dropout regulator of claim 13, wherein the toggle detector includes:

a D-type flip-flop including a clock input, wherein the D-type flip-flop is configured to receive the output of the first inverter on the clock input, wherein an output of the D-type flip-flop is a first logic level during a period of time in which the output of the first inverter is toggling from high to low or low to high, and wherein the output of the D-type flip-flop is a second logic level during a period of time in which the output of the first inverter is not toggling; and an adder that receives the output of the D-type flip-flop, the adder being configured to determine the number of times based on the output of the D-type flip-flop.

15. A low dropout regulator for providing an output voltage, the low dropout regulator comprising:

a power supply line;

a reference voltage supply circuit coupled to the power supply line and configured to receive an input supply voltage from the power supply line, the reference voltage supply circuit outputting a reference voltage based on the input supply voltage, wherein an increase in the input supply voltage causes the reference voltage to increase, and a decrease in the input supply voltage causes the reference voltage to decrease;

an error amplifier having a first input, a second input, and a single-ended output, wherein the first input is coupled to the reference voltage, and the second input is coupled to i) an output node of the low dropout regulator via a first feedback resistor, and ii) a ground node via a second feedback resistor;

an n-type MOS transistor including a gate terminal coupled to the single-ended output of the error amplifier, a source terminal coupled to the ground node, and a drain terminal coupled to the output node of the low dropout regulator; and a variable resistor coupled between the power supply line and the output node, wherein a resistance value of the variable resistor is set based on an amount of current sunk from a plurality of inverters to the output node, the plurality of inverters being coupled between the power supply line and the output node, wherein a power supply terminal of the error amplifier is coupled to the output node, the output node providing an output voltage of the low dropout regulator that powers the error amplifier, and wherein the error amplifier is configured to drive the n-type MOS transistor to an operating point that causes the output voltage to be approximately one half of the input supply voltage.

16. The low dropout regulator of claim 15, wherein a second power supply terminal of the error amplifier is coupled to the ground node.

17. The low dropout regulator of claim 15, wherein the low dropout regulator is embedded in a card interface, the card interface including the plurality of inverters.

18. The low dropout regulator of claim 17, wherein if it is determined that the amount of current sunk is increasing, the resistance value of the variable resistor is increased to restrict an amount of current flowing from the power supply line to the output node, and wherein if it is determined that the amount of current sunk is decreasing, the resistance value of the variable resistor is decreased to increase the amount of current flowing from the power supply line to the output node.

19. The low dropout regulator of claim 18 comprising:

a toggle detector configured to receive an output of one or more of the plurality of inverters and to determine a number of times the output toggles from high to low or low to high, wherein the number of times is indicative of the current sunk, and wherein the toggle detector generates a toggle output based on the number of times, the resistance value of the variable resistor being set based on the toggle output.

20. A system for supplying power to a card, the system comprising:

a power management integrated circuit (PMIC);

a card interface configured to receive an input supply voltage from the PMIC, the card interface including (i) a low dropout regulator, and (ii) a plurality of inverters, wherein the low dropout regulator includes:

a reference voltage supply circuit configured to receive the input supply voltage, the reference voltage supply circuit outputting a reference voltage based on the input supply voltage, wherein changes in the input supply voltage cause the reference voltage to change;

an error amplifier having a first input, a second input, and a single-ended output, wherein the first input is coupled to the reference voltage, and the second input is coupled to an output node of the low dropout regulator via a first feedback resistor, the plurality of inverters being coupled between the input supply voltage and the output node;

a pass transistor including a control electrode coupled to the single-ended output of the error amplifier, a first electrode coupled to a ground node, and a second electrode coupled to the output node of the low dropout regulator; and a variable resistor coupled between the input supply voltage and the output node, wherein a resistance value of the variable resistor is set based on an amount of current sunk from the plurality of inverters to the output node, and wherein a first power supply terminal of the error amplifier is coupled to the output node, the output node providing an output voltage of the low dropout regulator that powers the error amplifier.

* * * * *